United States Patent [19]

Dobler et al.

[11] Patent Number: 4,787,581

[45] Date of Patent: Nov. 29, 1988

[54] TRAIN DETECTION SYSTEM OPERATING IN ACCORDANCE WITH THE AXLE-COUNTING PRINCIPLE

[75] Inventors: Karl U. Dobler, Toronto, Canada; Helmut Uebel, Gerlingen, Fed. Rep. of Germany

[73] Assignee: Alcatel N.V., Amsterdam, Netherlands

[21] Appl. No.: 70,633

[22] Filed: Jul. 6, 1987

Related U.S. Application Data

[63] Continuation of Ser. No. 767,932, Aug. 21, 1985, abandoned.

[30] Foreign Application Priority Data

Aug. 24, 1984 [DE] Fed. Rep. of Germany ..... 3431171

[51] Int. Cl.[4] ..... B61L 1/16

[52] U.S. Cl. ..... 246/247; 246/28 F; 246/77; 246/122 R; 340/933

[58] Field of Search ..... 246/28 F, 122 R, 167 A, 246/247, 249, 28 R, 28 E, 77, 124; 340/933, 941

[56] References Cited

U.S. PATENT DOCUMENTS

| | | | |
|---|---|---|---|
| 3,450,875 | 6/1969 | Whitten et al. | 246/122 R |
| 3,740,549 | 6/1973 | Thorne-Booth | 246/122 R |
| 3,771,119 | 11/1973 | Evans | 340/988 |
| 3,870,990 | 3/1975 | Fathauer | 340/941 X |
| 4,128,218 | 12/1978 | Pohlig | 246/247 |
| 4,179,744 | 12/1979 | Lowe | 340/941 X |
| 4,283,031 | 8/1981 | Finch | 246/247 X |
| 4,494,717 | 1/1985 | Corrie et al. | 246/28 F |
| 4,498,650 | 2/1985 | Smith et al. | 246/122 R |
| 4,581,700 | 4/1986 | Farnham et al. | 246/122 R |

FOREIGN PATENT DOCUMENTS

| | | | |
|---|---|---|---|
| 2652233 | 5/1978 | Fed. Rep. of Germany | 246/77 |
| 2824573 | 12/1979 | Fed. Rep. of Germany | 246/122 R |
| 0845460 | 8/1960 | United Kingdom | 246/247 |
| 1505528 | 3/1978 | United Kingdom . | |

*Primary Examiner*—Robert B. Reeves
*Assistant Examiner*—Scott H. Werny
*Attorney, Agent, or Firm*—Christie, Parker & Hale

[57] ABSTRACT

A train detection system is disclosed which works on the axle-counting principle and in which preprocessing units each containing a two-microprocessor system are associated with the individual detection points. Along the track, a major number of preprocessing units are connected with a central evaluation unit which interrogates the preprocessing units for stored counts on a cyclic basis. This interrogation is performed separately for each microprocessor of a preprocessing unit. In addition to containing counts, data telegrams transmitted to the evaluation unit include functional characters which make it possible to check the correct functioning of the detection points and preprocessing units at short intervals.

5 Claims, 3 Drawing Sheets

GL
AD
GA3
GA2
GA1
VVE4
VVE3
VVE2
VVE1
KL
SL
SVL
SV2
ZA
SV1

| | | | | | | | | |
|---|---|---|---|---|---|---|---|---|
| A1 | A2 | A3 | A4 | A5 | ADF a | ADF b | AAR | ← DW1 |
| X1 | X2 | X3 | X4 | X5 | X6 | TB | RB | ← DW2 |
| CB1 | CB2 | CB3 | CB4 | CB5 | CB6 | CB7 | CB8 | ← DW3 |

| | | | | | | | | |
|---|---|---|---|---|---|---|---|---|
| A6 | A7 | A8 | A9 | A10 | AR | C1 | C2 | ← DW4 |
| C3 | C4 | C5 | C6 | C7 | C8 | C9 | C10 | ← DW5 |
| DF a | DF b | DR a | DR b | PS a | PS b | WP a | WP b | ← DW6 |
| CB9 | CB10 | CB11 | CB12 | CB13 | CB14 | CB15 | CB16 | ← DW7 |

TRAIN DETECTION SYSTEM OPERATING IN ACCORDANCE WITH THE AXLE-COUNTING PRINCIPLE

CROSS-REFERENCE TO RELATED APPLICATIONS

This is a continuation of application of Ser. No. 767,932 filed Aug. 21, 1985, now abandoned.

BACKGROUND OF THE INVENTION

1. Field of the Invention

The present invention relates to a train detection system.

2. Description of Related Art

Train detection systems of this nature have been known under the designation "axle counters" for some time. A detailed description thereof is contained in "Signal+Draht", Vol. 59 (1967), No. 11, pages 165 to 174. They work on the simple principle that a section of track defined by detection points is only indicated as being unoccupied if the number of axles having entered the section is equal to the number of axles having left the section. In order to be able to determine this, it is necessary to identify both the number and direction of travel of the axles passing a detection point at all direction points that define the section of track to be indicated as being unoccupied or occupied. In order to accomplish this in known systems, the signals from the axle detectors are first amplified and then provided to an evaluation unit, the so-called axle-counting group, via separate multiple-conductor cables. The number of axles and their direction of travel are determined in the evaluation unit.

The prior-art system is very expensive, primarily as a result of the fact that each section of track requires a separate evaluation unit and, if the section of track is defined by more than two detection points, requires further supplementary groups. Moreover, many cable links are required, as it is necessary for each detection point to be connected separately to the evaluation unit.

Further disadvantages of the prior-art train detection system operating in accordance with the axle-counting principle are the interference susceptibility of the transmission link between the detection points and the evaluation unit in the interlocking and the fact that it is not possible to check the components located in the outdoor equipment from the central evaluation unit.

SUMMARY OF THE INVENTION

It is therefore the object of the present invention to provide a train detection system of the type described at the outset whose operation is largely unsusceptible to interference, which permits those subcircuits located in the outdoor equipment to be checked from a central location and which, in addition, is less expensive than the prior-art train detection system if a stretch of track has to be equipped which is divided into a major number of track sections.

By processing the axle detector signals in the outdoor equipment, it is possible for the number of axles to be identified and stored there, thereby eliminating the need for real-time operation in the central evaluation unit in processing the occupied/unoccupied indication. However this is the prerequisite for being able to associate not only one, but a plurality of track sections with a single central evaluation unit.

The counts obtained at the individual detection points associated with a central evaluation unit are stored in output memories of the microprocessors contained in the preprocessing units and can be called up cyclically by the central evaluation unit. The maximum number of detection points that can be associated with an evaluation unit, and thus the number of track sections that can be assigned to it, depends upon the intervals of time at which occupied/unoccupied indications are to be outputted for a section of track.

Transmission of the counts stored in the preprocessing units, as well as polling thereof, can be performed via a common data line, in accordance with any desired data communication method that is suitable therefor.

And finally, parallel processing of the axle detector signals from each detection point in two microprocessors, independent one from the other, and separate transmission of the counts from both microprocessors to the evaluation unit permits the operation of the two microprocessors to be checked by means of a comparison performed in the central evaluation unit.

An embodiment of the present invention represents a simple possibility for counting the axles entering and leaving the section of track through the employment of customary microprocessors.

Other embodiments of the present invention serve to reduce interference susceptibility.

An embodiment of the present invention permits the operation of the axle detectors and the subsequent time filters, or the microprocessors if the function of the time filters is performed by such units, to be checked. The above-indicated check for proper operation is performed at the request of the central evaluation unit. The result of the check is buffered and called up by the central evaluation unit together with the counts. This permits ongoing receipt of current check results from axle detection points, even in the case of tracks that are not heavily travelled.

Another embodiment permits the output voltage drift of the axle detectors to be monitored. Maintenance can then be provided for axle detectors whose output voltage varies from a predetermined range before the detection point fails.

BRIEF DESCRIPTION OF THE DRAWINGS

A practical example of the train detection system according to the present invention will now be described in detail, and its theory of operation explained, with reference to the accompanying drawings, in which.

DESCRIPTION OF THE PREFERRED EMBODIMENTS

Figure 1:
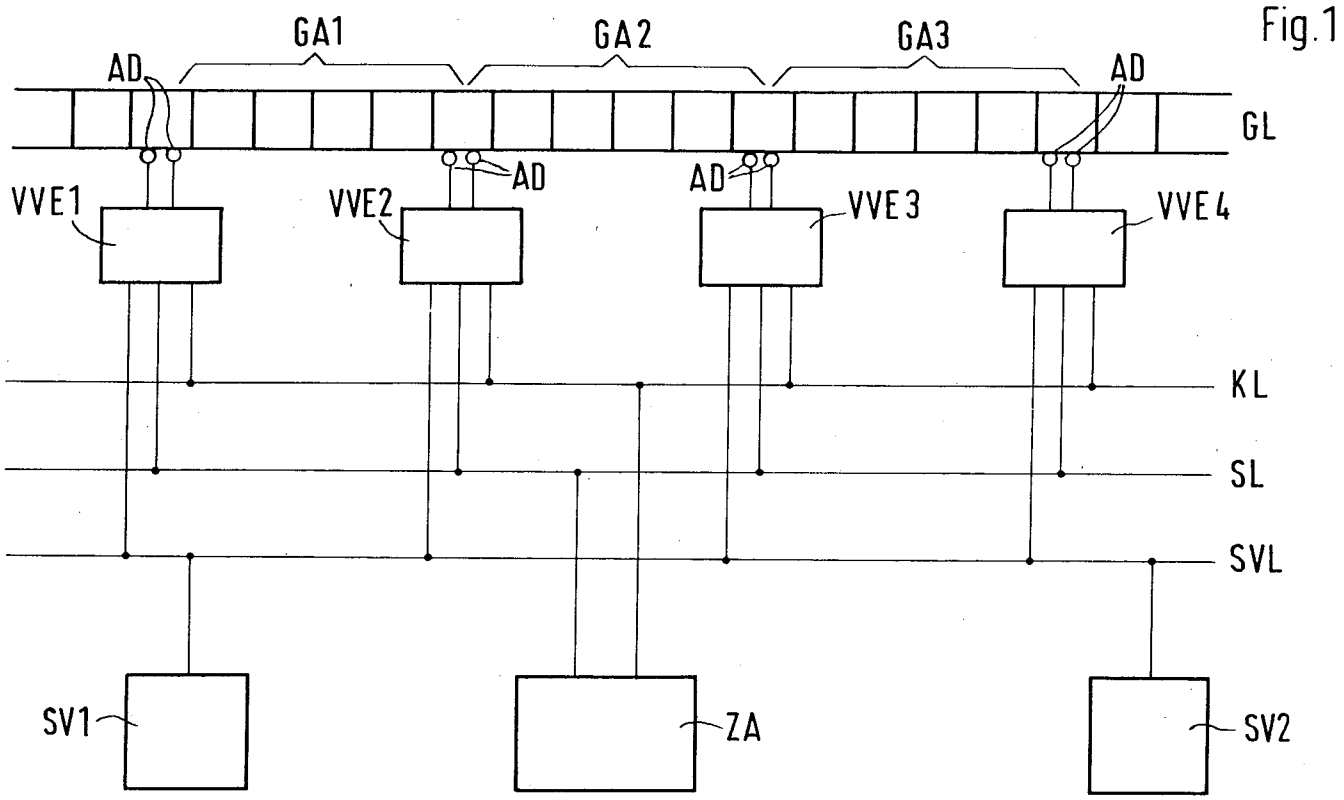
FIG. 1 shows a schematic representation illustrating a stretch of track equipped with the system in accordance with the present invention.

Illustrated in FIG. 1 is a stretch of track GL, which is divided into sections of track GA1, . . . , GA3 by means of detection points. Each detection point includes two axle detectors AD, staggered one relative to the other, as well as a preprocessing unit VVE1, . . . , VVE4. A common command line KL and a common status line SL connect the preprocessing units with a central evaluation unit ZA, which, as in the case of the conventional axle-counting groups employed in known axle-counting systems, is located in the interlocking station. In the case of an electronic interlocking controlled by a central computer system, it would also be conceivable for the function of the central evaluation unit to be performed by the central computer system, itself, thereby eliminating the need for a separate evaluation unit. The preprocessing units, including the axle detectors of all detection points, are supplied from one or more parallel-connected power supply units SV1, SV2 via a common power supply line SVL.

When a train travels over the stretch of track illustrated in FIG. 1, a count pulse is formed in the axle detectors of the detection points every time an axle passes. However the count pulses are not sent directly to the central evaluation unit, but are counted and stored in the preprocessing unit associated therewith, with the count pulses being counted up or down as a function of the sequence of axle count pulses of the two axle detectors of a detection point.

The counts stored in the preprocessing units are called up cyclically by the associated central evaluation unit, with the cycle duration depending upon the number of detection points associated with the central evaluation unit. The individual sections of track are indicated as being occupied or unoccupied following comparison by the central evaluation unit of the results obtained at the detection points that define the respective sections of track. If the net number of axles of a section of track corresponds to a number previously identified for a section of track which had been evidenced as being unoccupied (basic setting), an unoccupied condition is indicated. If the net number of axles does not agree with the basic setting, the section of track will continue to be indicated as being occupied.

In order to be able to verify proper operation of a detection point, the numbers of axles at each detection point are determined in a two-channel mode and called up separately. For this purpose, each of the preprocessing units contains, in accordance with FIG. 2, two microprocessors MR1, MR2, to which the axle count pulses from axle detectors AD1, AD2 are supplied in parallel. Axle detector AD1 supplies its count pulses to the increment inputs of the two microprocessors via line 3, for example, while axle detector AD2 outputs its count pulses to the decrement inputs of the two microprocessors via line 4. The two microprocessors are programmed in such a manner that only the first count instruction received, incrementation or decrementation, is performed by each. Should axle detector AD1 respond first, the corresponding count pulse is thus counted up. If, on the contrary, axle detector AD2 responds first, the count pulse is counted down.

Both microprocessors MR1, MR2 are connected with status line SL and command line KL by means of one UART (Universal Asynchronous Receiver Transmitter) U1, U2 each and a common modem MO and can be called up centrally by the central evaluation unit (unillustrated in FIG. 2) via these lines. Call-up is performed by means of a command telegram, which contains, in encoded form, the address of the microprocessor being polled and the command to be executed. The microprocessor being polled responds with a status telegram containing the count determined by the microprocessor, as well as a number of further messages, which will be described below, in addition to its address. The command telegrams are outputted serially to command line KL by the central evaluation unit, e.g. in the form of remote switching command signals, demodulated in the preprocessing unit modems and converted into parallel data bytes in the UART modules. These parallel data bytes are read into the microprocessors via busses 1, 2 and processed there. Status telegrams are provided by the microprocessors in the form of a sequence of 4 bytes in parallel form, converted from parallel to serial form by the UART modules, modulated onto a carrier by the preprocessing unit modems and outputted onto status line SL. The clock signal for the UART modules is derived from the clock signal of respectively associated microprocessors MR1, MR2 via dividers T1, T2. Each command telegram is answered immediately by a status telegram from the polled microprocessor. If a faulty response is received, or none at all, the call is repeated. Should no response be received from the microprocessor in question, even after it has been polled several times, this microprocessor is viewed as being faulty.

Thanks to the second, properly operating microprocessor, a detection point containing a defective microprocessor initially remains operable. Should an entire detection point (both microprocessors) fail, the two sections of track adjacent to the detection point in question can be combined into one single, longer section of track in the central evaluation units, thereby permitting safe train operations to be continued. Combining sections in this manner effects only train distancing, however not the safety of operations. No alternative action of the type required in the case of prior-art axle-counting systems is necessary. Thanks to central evaluation of the counts obtained from a plurality of sequential detection points, count errors can be identified and corrected with little additional circuitry. Should a section of track fail to be indicated as being unoccupied after a train has passed through it, the counts of the next adjacent detection point and, if necessary, those of the detection point following this next adjacent detection point are utilized for comparison purposes, thereby permitting a possible count error to be identified as such. Moreover, interference which could result in count errors, such as inductive interference, for example, is eliminated by means of a time filter circuit or an appropriate processor routine, which excludes count pulses whose duration is shorter than a stipulated pulse duration, which is matched to the maximum speed of the trains, from the count. Since its operation is very important, it is possible to verify the proper operation of said time filter. This is performed by means of a corresponding command from the central evaluation unit, which initiates output of a special check pulse by the polled microprocessor. The duration of this check pulse is just below the minimum duration stipulated for the axle count pulses and is supplied to a reference voltage changeover unit RU1, RU2. The two reference voltage changeover units contained in a preprocessing unit can access both axle detectors AD1, AD2 via an OR gate OG and alter their reference voltages for the duration of the check pulse. This briefly simulates an axle count pulse of insufficient duration in each axle detector, which is analyzed by the microprocessors and identified as being a check pulse. While a pulse of this nature is not counted, its arrival is reported to the central evaluation unit with the next status telegram. In addition to the above-mentioned operation of the time filters, it is thus possible for the central evaluation unit to check the correct functioning of the entire axle-counting channel, comprising axle detectors and microprocessors, especially at detection points along stretches of track that are not heavily travelled, at which true axle count pulses are not produced for extended periods of time.

Figure 2:
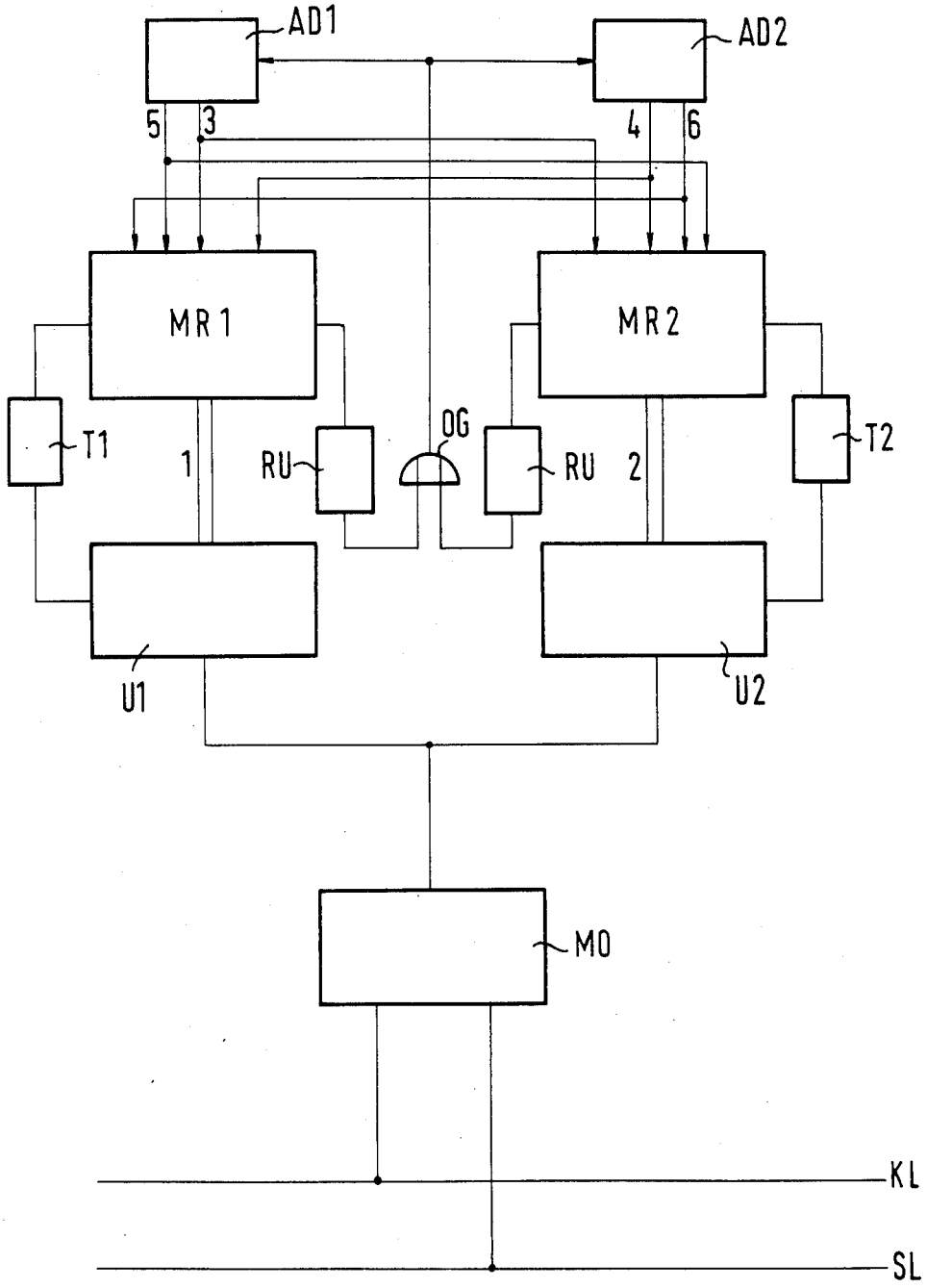
FIG. 2 shows a block schematic diagram of a detection point with the associated preprocessing unit.

In additon to the above-indicated verification function, the preprocessing unit shown in FIG. 2 can also perform further checks. These include a comparison of the count pulse sequences supplied by axle detectors AD1, AD2, which is performed in each microprocessor and permits defective operation of an axle detector to be identified, causing a failure message to be included within the status telegram. The output voltage drift of the axle detectors can also be monitored. To accomplish this, the output voltages supplied by the axle detectors in the uninfluenced state are sensed by both microprocessors via lines 5 and 6 and compared with a predetermined voltage. Should an output voltage vary excessively from the predetermined value, a warning signal is outputted within the status telegram, indicated that maintenance of the axle detector in question is required.

A special subroutine in the microprocessors analyzes continuous signals from the axle detectors. These continuous signals are produced if an axle comes to rest and remains stationary directly above an axle detector. In this case, it is necessary for the section of track to remain indicated as occupied even if no count pulses have been outputted and counted yet.

Figures 3A, 3B, 3C:
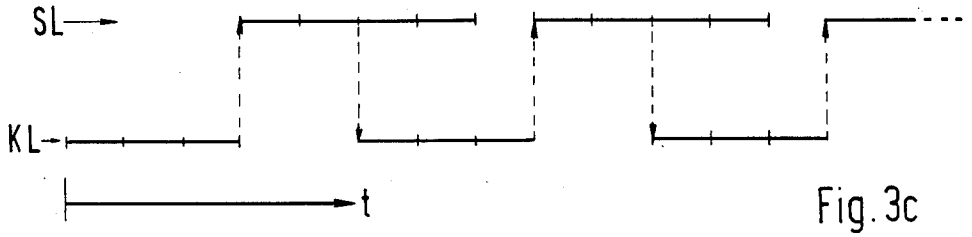
FIGS. 3*a*–3*c* show the structure of command and status telegrams required for data exchange, as well as synchronization thereof.

The design and structure of the command telegrams and status telegrams are shown in FIGS. 3*a* and 3*b*. FIGS. 3*c* shows a possibility for synchronizing command and status telegrams.

As can be seen from FIG. 3*a*, a command telegram consists of three data words DW1, . . . , DW3, with each data word comprising 8 bits. First data word DW1 contains 5 address bits A1, . . . , A5 and 3 bits ADFa, ADFb, AAR, which are employed for confirming safety messages outputted by the preprocessing unit in a previous status telegram, in this case a defect in the axle detectors (2 bits) and counter reset following a power failure (1 bit). In addition to 6 unused bits X1, . . . , X6, the second data word contains a chheck bit TB, which serves as the call for check pulse output, as well as a reset bit RB, which resets the axle pulse counter after having been received twice in sequence. The third data word contains only redundancy bits CB1, . . . , CB8 for information backup purposes.

As can be seen from FIG. 3*b*, a status telegram consists of 4 data words DW4, . . . DW7, with the first data word containing five address bits, A6, . . . , A10, one bit AR for indicating counter reset following a power failure, and two bits C1, C2 for transmitting the count together with all 8 bits C3, . . . , C10 of second data word DW5. Third data word DW6 contains only bits for special messages, such as indication of axle detector defects (DFa, DFb), drift warnings in the event of axle detector output voltage drift (DRa, DRb), check pulse identification after a request to output a check pulse (PSa, PSb) and the continuous signal from an axle detector in the event that an axle comes to rest and remains stationary directly above the axle detector (WPa, WPb). The fourth data word contains only redundancy bits CB9, . . . , CB16 for information backup purposes.

For transmission purposes, the individual data words are additionally provided with a start bit, a parity bit, and two stop bits, so that a command telegram consists of 3 data blocks of 12 bits each, and a status telegram consists of 4 data blocks of 12 bits each.

Synchronization between command and status telegrams is illustrated by FIG. 3*c*, in which occupation of command line KL and status line SL is illustrated as a function of time. If the data transmission period for a data word amounts to 10 milliseconds, which represents a realistic value, 100 milliseconds are required to query a detection point, with the two microprocessors of the preprocessing unit being queried separately. If 16 detection points are associated to a central evaluation unit, and all detection points are queried cyclically, each detection point would be queried once every 1.6 seconds.

We claim:

1. In a train detection system for sections of track each defined by at least two detection points each of which is formed by at least two axle detectors staggered one relative to the other, arranged along the rails of the track and providing axle-presence signals:

a central evaluation unit which indicates a particular track section as being occupied or unoccupied depending upon the number of axles counted at the associated detection points as axles entering the track section and as axles leaving the track section, a preprocessing unit provided in the immediate vicinity of each detection point and associated therewith, each preprocessing unit containing processing means for separate processing of the axle detector signals only from the associated detection point and accumulating a separate multi-bit count which is incremented each time an axle is detected as having passed the associated detection point in a first direction and which is decremented each time an axle is detected as having passed said associated detection point in a second direction, as well as a data transmitter-receiver for call-controlled transfer of the accumulated multi-bit count to the central evaluation unit, and call-up means associated with said central evaluation unit for cyclically calling up the counts stored by each of the preprocessing units.

2. The train detection system according to claim 1, wherein the preprocessing unit contains a voltage-check circuit which measures the output voltage of the axle detectors in the uninfluenced state and outputs a warning signal if either or both of said output voltages leave a predetermined range.

3. A train detection system for sections of track which are defined by detection points each of which is formed by a pair of axle detectors staggered one relative to the other, arranged along the rails of the track and providing axle-presence signals, wherein a plurality of detection points is assigned to a central evaluation unit which indicates a track section as being occupied or unoccupied depending upon the number of axles counted at the associated detection points as axles entering the track section and as axles leaving the track section, characterized in that a preprocessing unit is provided in the immediate vicinity of each detection point and associated therewith, each preprocessing unit containing two microprocessors for separate, parallel processing and counting of the axle detector signals and buffering of the counts, as well as a data transmitter-receiver for call-controlled transfer of these counts to the central evaluation unit, and in that a comparison of the counts determined by the microprocessors of a preprocessing unit is performed in the central evaluation unit and further employment of these counts is prevented if the comparision shows in disagreement, further characterized in that in each preprocessing unit, each microprocessor has a check-pulse circuit associated with it which amplifies a check pulse outputted by the associated microprocessor in response to an instruction from the central evaluation unit and having a duration shorter than a predetermined minimum duration of the axle detector signals, and feeds the amplified check pulse to the axle detectors, in that in the axle detectors the check pulse generates a simulated axle count pulse having the duration of the check pulse, and in that the microprocessors output a special signal to the central evaluating unit when a simulated axle count pulse of this nature has been received.

4. In a train detection system for sections of track which are defined by detection points each of which is formed by at least two axle detectors staggered one relative to the other, arranged along the rails of the track and providing axle-presence signals:

a central evaluation unit which indicates a track section as being occupied or unoccupied depending upon the number of axles counted at the associated detection points as axles entering the track section and as axles leaving the track section, a preprocessing unit provided in the immediate vicinity of each detection point and associated therewith, each preprocessing unit containing two processing means for separate, parallel processing of the axle detector signals and for accumulating two separate multi-bit counts each of which being incremented each time an axle is detected as having passed the associated detection point in a first direction and decremented each time an axle is detected as having passed said associated detection point in a second direction, as well as a data transmitter-receiver for call-controlled transfer of the multi-bit count accumulated by each of said two processing means to the central evaluation unit, and call-up means associated with said central evaluation unit for cyclically calling up the counts stored by each of the preprocessing units, wherein a comparison of the counts determined by the two processing means of a preprocessing unit is performed in the central evaluation unit and further employment of these counts is prevented if the comparison shows any disagreement.

5. The train detection system according to claim 4, wherein the outputs of the axle detectors of a detection point are connected with permanently associated inputs of both processing means of the preprocessing unit associated with the detection point, and the processing means function in such a manner that the accumulated count is incremented or decremented depending upon the relative time sequence of the signals provided by the axle detectors.

* * * * *